US008857206B2

(12) United States Patent
Fulton et al.

(10) Patent No.: US 8,857,206 B2
(45) Date of Patent: Oct. 14, 2014

(54) MULTIFUNCTION DISPENSER ACTUATION PAD

(75) Inventors: Timothy A. Fulton, Evansville, IN (US); Daryl L. Harmon, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 614 days.

(21) Appl. No.: 12/631,887

(22) Filed: Dec. 7, 2009

(65) Prior Publication Data

US 2011/0132021 A1 Jun. 9, 2011

(51) Int. Cl.

| | |
|---|---|
| ***F25D 3/00*** | (2006.01) |
| ***F25D 23/12*** | (2006.01) |
| ***F25C 5/00*** | (2006.01) |

(52) U.S. Cl.

CPC ..... *F25D 23/126* (2013.01); *F25C 2400/10* (2013.01); *F25C 5/005* (2013.01)

USPC ..... 62/389; 62/390; 222/146.6; 141/356

(58) Field of Classification Search

CPC ..... F25D 23/005; F25D 25/00; F25D 23/04; F25C 5/005; B67D 2001/0089

USPC ..... 62/289–290, 389–390; 222/146.6, 222/129.1, 130; 141/362, 356

See application file for complete search history.

(56) References Cited

U.S. PATENT DOCUMENTS

| | | | | |
|---|---|---|---|---|
| 5,474,213 | A | 12/1995 | Unger | |
| 6,135,173 | A * | 10/2000 | Lee et al. | 141/361 |
| 6,658,887 | B2 | 12/2003 | Lee et al. | |
| 6,679,082 | B1 | 1/2004 | Tunzi | |
| 7,007,200 | B2 | 2/2006 | Salem | |
| 7,076,967 | B2 | 7/2006 | Lee et al. | |
| 7,137,272 | B2 | 11/2006 | Park et al. | |
| 7,222,498 | B2 | 5/2007 | Lee et al. | |
| 7,287,555 | B2 * | 10/2007 | Heger et al. | 141/86 |
| 7,340,914 | B2 | 3/2008 | Bowen et al. | |
| 7,340,915 | B2 | 3/2008 | Kwon | |
| 2004/0187516 | A1 | 9/2004 | Lee | |
| 2010/0319388 | A1 | 12/2010 | Yang | |

FOREIGN PATENT DOCUMENTS

| | | | | |
|---|---|---|---|---|
| KP | 100794601 | * | 1/2008 | F25D 25/00 |
| WO | 2009008620 | A2 | 1/2009 | |

* cited by examiner

*Primary Examiner* — Cassey D Bauer

(57) ABSTRACT

A refrigerator includes refrigerator cabinet, a door attached to the refrigerator cabinet, an ice and water dispenser mounted at the door for dispensing ice and water through the door, the ice and water dispenser including a multifunction dispensing actuation pad having a plurality of actuation points and wherein ice or water is dispensed upon selectively applying a pressure to one of the plurality of actuation points on the dispensing actuation pad. A method of operating a refrigerator includes the steps of providing a refrigerator and selectively applying pressure to at least one of a plurality of actuation points on a dispensing actuation pad of the refrigerator to select an ice and water dispenser function.

8 Claims, 4 Drawing Sheets

MULTIFUNCTION DISPENSER ACTUATION PAD

FIELD OF INVENTION

This invention relates generally to a refrigerator. More particularly, the present invention relates to a refrigerator with an ice and water dispenser which includes an actuation pad.

BACKGROUND OF THE INVENTION

As is well known, refrigerators may be provided with ice and water dispensers. Such dispensers are typically mounted on an outer surface of a refrigerator door. Each dispenser typically has a lever, actuator button, or actuator pad. In operation, a glass is pressed against the actuator button, pad, or lever, thus activating the dispensing of water or ice cubes, as desired. In some refrigerators, there are multiple levers present (one for ice, one for water).

Where an actuator pad is used, a user typically selects a dispensing function (such as water, or cubed ice, or crushed ice) and then presses the glass against the actuator pad to initiate dispensing. One of the problems with this approach is that where a user wishes to dispense both ice and water into a glass, the user must first select ice, press the glass against the actuation pad to fill with ice, then select water, and press the glass against the actuation pad to fill with water.

What is needed is an actuator pad which is more convenient for a user and does not require both the selection of the dispensing function and the pressing of the galls against the actuation pad in order to perform the dispensing function.

SUMMARY OF THE INVENTION

Therefore it is a primary object, feature, or advantage of the present invention to improve upon the state of the art.

It is a further object, feature, or advantage of the present invention to provide a dispenser actuation pad which can achieve multifunction by providing a plurality of actuation points wherein actuation is different between top and bottom, side to side, or other configuration.

It is still a further object, feature, or advantage of the present invention to provide a multifunction dispenser actuation pad which can be selectively configured by a user via a user interface.

One or more of these and/or other objects, features, and advantages of the present invention will become apparent from the specification and claims that follow. No single embodiment of the present invention need exhibit all of these objects, features, or advantages.

According to one aspect of the present invention, a refrigerator includes a refrigerator cabinet, a door attached to the refrigerator cabinet, an ice and water dispenser mounted at the door for dispensing ice and water through the door, the ice and water dispenser including a multifunction dispensing actuation pad having a plurality of actuation points and wherein ice or water is dispensed upon selectively applying a pressure to one of the plurality of actuation points on the dispensing actuation pad.

According to another aspect of the present invention, the plurality of actuation points includes a first point associated with a first actuator and a second point associated with a second actuator. Applying pressure to the first actuator actuates the first actuator thereby dispensing ice while applying pressure to the second actuator actuates the second actuator thereby dispensing water. In still a further aspect, applying pressure to the first point actuator actuates the first actuator thereby dispensing cubed ice while applying pressure to the second actuator actuates the second actuator thereby dispensing crushed ice.

In still a further aspect of the present invention, a refrigerator is provided which includes a refrigerator cabinet, a door attached to the refrigerator cabinet, an ice and water dispenser mounted at the door for dispensing ice and water through the door, the ice and water dispenser including a multifunction dispensing actuation pad comprising a plurality of actuators, and a user interface operatively connected at the door, the user interface providing for receiving user configurations associating one or more of the plurality of actuators with one or more of a plurality of ice and water dispensing functions.

In another aspect of the invention, a method is provided for operating a refrigerator, comprising: providing a refrigerator comprising a refrigerator cabinet, a door attached to the refrigerator cabinet, and an ice and water dispenser mounted at the door for dispensing ice and water through the door, the ice and water dispenser including a multifunction; dispensing actuation pad having a plurality of actuation points; and selectively applying pressure to at least one of the plurality of actuation points on the dispensing actuation pad to select an ice and water dispenser function.

DETAILED DESCRIPTION OF THE PREFERRED EMBODIMENT

Figure 1:
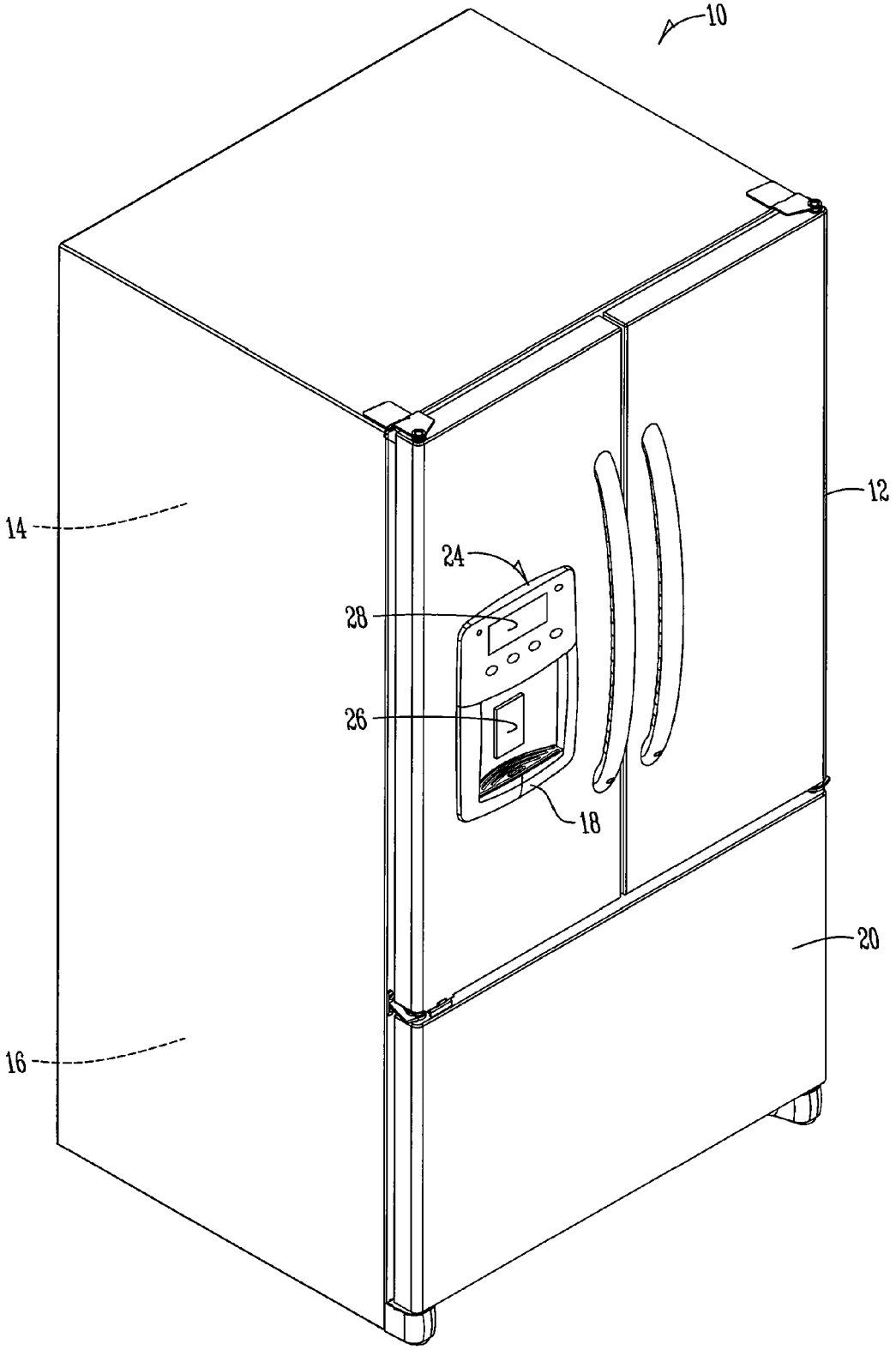
FIG. 1 is a perspective view of a refrigerator incorporating the multifunction dispenser actuation pad.

Referring to FIG. 1, an exemplary embodiment of the present invention is shown which provides significant advantages and benefits. Refrigerator 10 is shown to include a refrigerator cabinet 12 defining a fresh food compartment 14 and a bottom freezer compartment 16. The fresh food compartment 14 and the freezer compartment 16 are sealed by the fresh food compartment door 18 and the freezer compartment door 20, respectively. The fresh food compartment 14 is generally maintained at above 0° C. temperatures and the freezer compartment 16 maintained at below 0° C. temperatures. Disposed on the fresh food compartment door 18 is an ice and water dispenser 24, generally including an actuation pad 26 and display 28. It can be appreciated that ice and water dispenser 24 can be found in refrigerators of side-by-side construction as well as other designs.

Figure 3:
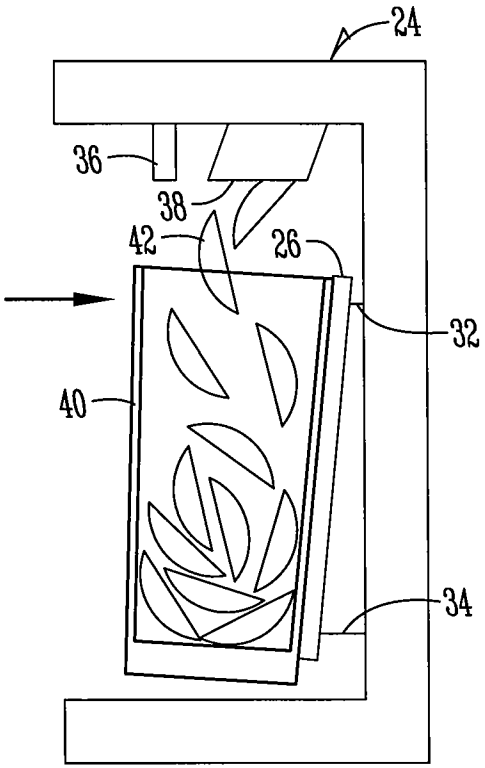
FIG. 3 is a side view of the multifunction dispenser actuation pad wherein pressure is applied to a first actuator.
Figure 2:
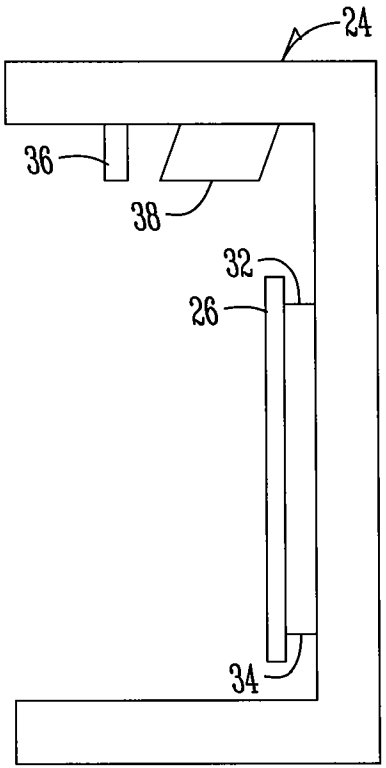
FIG. 2 is a side view of the multifunction dispenser actuation pad.

FIG. 2 provides a side view of the ice and water dispenser 24. The ice and water dispenser 24 provides a fill tube 36 and an ice tube 38. Actuation pad 26 is operatively associated with a plurality of actuation points, first actuator 32 and second actuator 34. Ice and water is dispensed upon selectively applying a pressure to one (or more) of the plurality of actuation points on the dispensing actuation pad. As best shown in FIG. 3, applying pressure to the first actuator 32 actuates the first actuator 32 thereby dispensing ice 42 into container 40.

Figure 4:
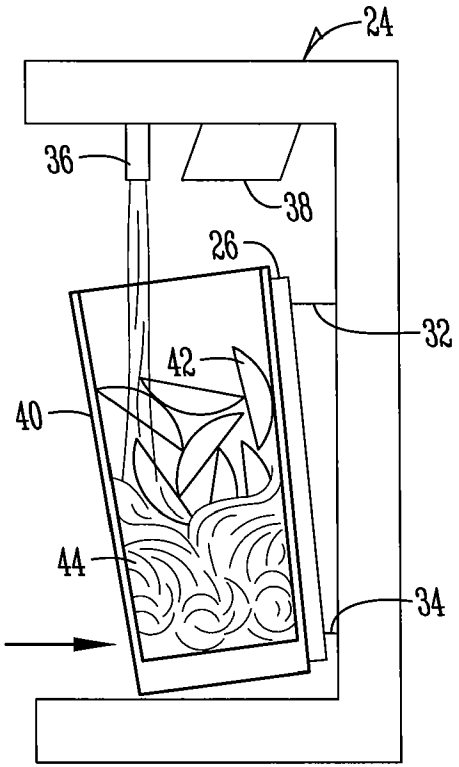
FIG. 4 is a side view of the multifunction dispenser actuation pad wherein pressure is applied to a second actuator.

FIG. 4 further illustrates that applying pressure to the second actuator 34 actuates the second actuator 34 thereby dispensing liquid 44 into container 40. In still a further embodiment, applying pressure to the first point actuator 32 actuates the first actuator 32 thereby dispensing cubed ice while applying pressure to the second actuator 34 actuates the second actuator 34 thereby dispensing crushed ice. Although in this example, two actuators are shown, the present invention contemplates that more than two actuators may be used.

Figure 5:
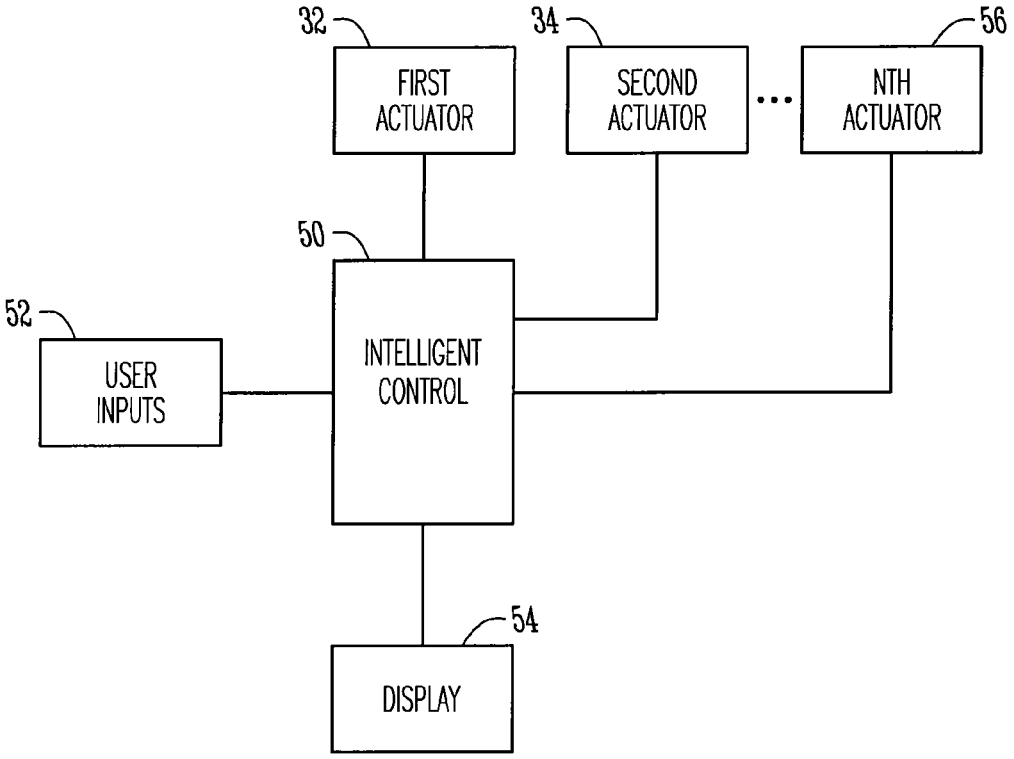
FIG. 5 is a block diagram of the multifunction dispenser actuation pad.

Now with reference to FIG. 5, a block diagram in accordance with the present invention is shown. Intelligent control 50 is operatively connected to a plurality of actuators 32, 34, 56 and a display 54. User inputs 52 are also operatively connected to the intelligent control. The user inputs 52 may be buttons or switches. Where the display 54 is a touch screen display, the user inputs 52 may be integrated into the display 54. A user can configure the actuation pad by pressing the actuation pad to selectively actuate one or more actuators 32, 34, 56 and then associating a dispensing function with that selection. Thus, for example, where two actuators are spaced apart with horizontal alignment, a user can press a glass against the actuation pad to actuate the leftmost actuator and associate a "dispense water" function with that configuration. A user may then press the glass against the actuation pad to actuate the rightmost actuator and associate a "dispense cubed ice function" with that configuration. A user may then press the glass against the actuation pad to actuate both actuators and associate a "dispense cubed ice and water simultaneously" function with that configuration. It should be appreciated that based on the number and position of the actuations, various configurations may be used.

Figure 6:
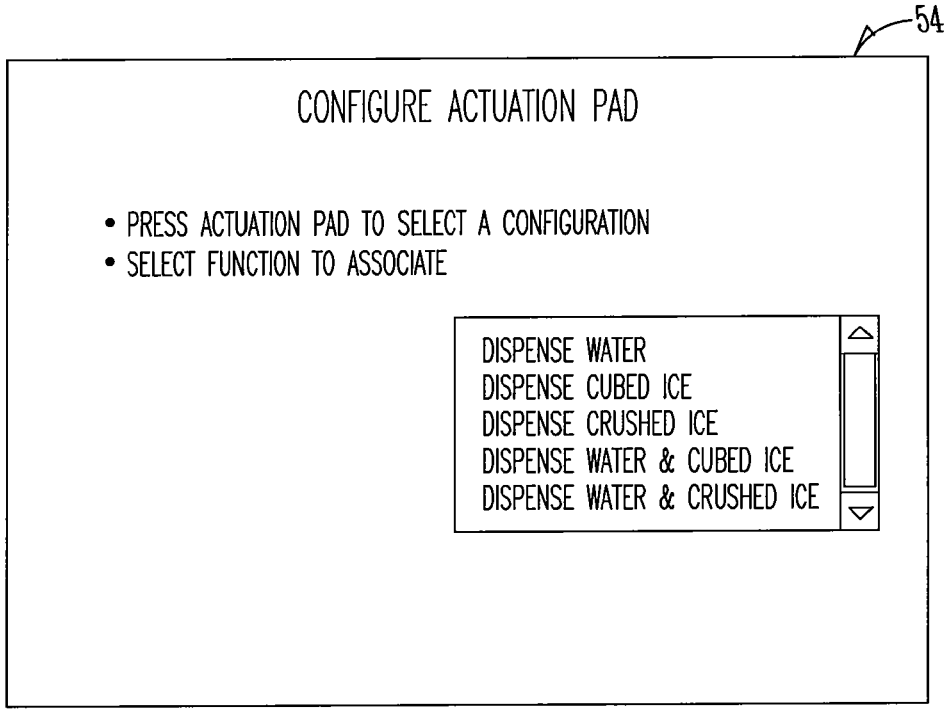
FIG. 6 is a graphical representation of the user interface of the multifunction dispenser actuation pad.

FIG. 6 provides one illustration of a screen display associated with the display 54. The display 54 is considered a part of the user interface of the refrigerator 10. FIG. 6 illustrates that a user may press the actuation pad to select a configuration and associate the configuration with one or more ice and water dispenser functions.

Alternatively, instead of pressing the glass against the actuation pad as a part of the configuration process, the user can assign different configurations of the actuation pad to different ice and water dispenser functions through use of a user interface of the refrigerator. The user interface includes the user inputs 52 and the display 54.

Further provided is a method of operating a refrigerator including the steps of providing a refrigerator comprising a refrigerator cabinet, a door attached to the refrigerator cabinet, and an ice and water dispenser mounted at the door for dispensing ice and water through the door, the ice and water dispenser including a multifunction dispensing actuation pad having a plurality of actuation points and selectively applying pressure to at least one of the plurality of actuation points on the dispensing actuation pad to select an ice and water dispenser function. In operation, the ice and water dispensing function is selected from the set consisting of dispensing a fluid, dispensing ice, dispensing crushed ice, and dispensing cubed ice.

Having thus described a preferred embodiment and other embodiments of an apparatus and method for multifunction dispenser actuation pad, it should be apparent to those skilled in the art that certain advantages of the present invention have been achieved. It should also be appreciated that various modifications, adaptations, and alternatives may be made, all within the spirit and scope of the present invention.

What is claimed is:

1. A refrigerator, comprising:

a refrigerator cabinet;

a door attached to the refrigerator cabinet;

an ice and water dispenser mounted at the door for dispensing ice and water through the door; the ice and water dispenser including (a) a fill tube, (b) an ice tube, (c) a multifunction dispensing actuation pad positioned below the fill tube and the ice tube in a recessed cavity, the multifunction dispensing actuation pad having a pad surface and (d) a plurality of actuation points on the multifunction dispensing actuation pad arranged to allow for simultaneous activation of more than one of the actuation points when pressure is applied to the pad surface;

wherein ice or water is dispensed upon selectively applying a pressure to the pad surface so as to activate one of the plurality of actuation points on the dispensing actuation pad;

wherein the plurality of actuation points includes a first point associated with a first actuator and a second point associated with a second actuator and wherein the first point and the second point are on opposing sides of a pivot point of the multifunction dispensing actuation pad;

wherein applying pressure to the first point actuates the first actuator thereby dispensing ice;

wherein applying pressure to the second point actuates the second actuator thereby dispensing water.

2. The refrigerator of claim 1 wherein the ice is cubed ice.

3. The refrigerator of claim 1 wherein the ice is crushed ice.

4. The refrigerator of claim 1 further comprising a user interface at the door, the user interface configured to receive a user configuration for the multifunction dispensing actuation pad.

5. The refrigerator of claim 4 wherein the user configuration provides for selectively associating actuation points with dispensing functions.

6. The refrigerator of claim 5 wherein the dispensing functions are selected from the set consisting of dispensing a fluid, dispensing ice, dispensing crushed ice, and dispensing cubed ice.

7. The refrigerator of claim 1 wherein the door is a fresh food compartment door.

8. A refrigerator, comprising:

a refrigerator cabinet;

a door attached to the refrigerator cabinet;

an ice and water dispenser mounted at the door for dispensing ice and water through the door; the ice and water dispenser including (a) a fill tube, (b) an ice tube, (c) a multifunction dispensing actuation pad positioned below the fill tube and the ice tube in a recessed cavity, and (d) a plurality of actuation points on the multifunction dispensing actuation pad arranged to allow for simultaneous activation of more than one of the actuation points;

wherein ice or water is dispensed upon selectively applying a pressure to one of the plurality of actuation points on the dispensing actuation pad;

wherein the plurality of actuation points includes a first point associated with a first actuator and a second point associated with a second actuator and wherein the first point and the second point are on opposing sides of a pivot point of the multifunction dispensing actuation pad;

wherein applying pressure to the first point actuates the first actuator thereby dispensing ice;

wherein applying pressure to the second point actuates the second actuator thereby dispensing water.

* * * * *